343-909 SR
10/20/87 XR 4,701,765

United States Patent [19]
Arduini et al.

[11] Patent Number: 4,701,765
[45] Date of Patent: Oct. 20, 1987

[54] STRUCTURE FOR A DICHROIC ANTENNA

[75] Inventors: Carlo Arduini; Renato Barboni; Antonio Castellani; Ugo Ponzi, all of Rome; Paolo Bielli, Corio; Salvatore Contu, Pecetto Torinese, all of Italy

[73] Assignee: Cselt-Centro Studi e Laboratori Telecomunicazioni S.p.A., Turin, Italy

[21] Appl. No.: 790,859

[22] Filed: Oct. 24, 1985

[30] Foreign Application Priority Data

Nov. 8, 1984 [IT] Italy ..... 68112 A/84

[51] Int. Cl.[4] ..... H01Q 19/95; H01Q 19/18
[52] U.S. Cl. ..... 343/897; 343/781 CA; 343/909
[58] Field of Search ..... 343/909, 781 CA, 910, 343/897, 914

[56] References Cited

U.S. PATENT DOCUMENTS

| | | | |
|---|---|---|---|
| 3,047,860 | 7/1962 | Swallow et al. | 343/897 |
| 3,394,378 | 7/1968 | Williams et al. | 343/909 X |
| 4,222,054 | 9/1980 | Capps | 343/754 |
| 4,272,770 | 6/1981 | Miller et al. | 343/909 X |
| 4,274,098 | 6/1981 | Renearu et al. | 343/781 CA |
| 4,378,561 | 3/1983 | Hibbard et al. | 343/912 |
| 4,387,377 | 6/1983 | Kandler | 343/909 X |
| 4,490,723 | 12/1984 | Hardie et al. | 343/909 X |
| 4,599,623 | 7/1986 | Havkin et al. | 343/909 X |

*Primary Examiner*—Daniel M. Yasich
*Attorney, Agent, or Firm*—Karl F. Ross; Herbert Dubno

[57] ABSTRACT

This structure for a dichroic antenna can be used in a reflector antenna capable of operating at the same time at two different frequencies or with two orthogonal polarizations, and presents mechanical characteristics allowing its use on board the satellites. The structure, suitable for a subreflector, comprises a plurality of layers with high mechanical stiffness in the external part, followed by layers with low dielectric constant and one or a plurality of metallic grids in the most internal part, separated by low-dielectric constant layers.

4 Claims, 2 Drawing Figures

STRUCTURE FOR A DICHROIC ANTENNA

FIELD OF THE INVENTION

The present invention concerns telecommunications antennas operating in the microwave range and more particularly it relates to a structure for a dichroic antenna, i.e. capable of a selective behavior either to different-frequency signals or to electromagnetic fields with orthogonal polarization. It may be used in single or double-reflector antennas.

BACKGROUND OF THE INVENTION

It is known that to achieve maximum transmission efficiency in radiofrequency telecommunications systems, and chiefly, in those using artificial satellites, each antenna is to be used for the simultaneous transmission or reception of two different signals, while keeping as low as possible ohmic losses and mutual interferences. Moreover, if the antenna is installed on board a satellite its weight and encumbrance must be reduced as much as possible.

A solution to this problem is that of using a double-reflector antenna having a subreflector capable of generating a reflection at the virtual focus for the main reflector for one frequency or polarization and at the same time of allowing the operation of a feed placed in the primary focus for a second frequency or orthogonal polarization. Of course, a new feed can be placed at the virtual focus.

This can be achieved if the subreflector is selective to the frequency or to the polarization of the received or transmitted signal.

In this way it is transparent at a certain frequency or polarization, allowing the operation of the feed placed at the primary focus, and is reflecting at another frequency or polarization, allowing the operation of the feed placed at the virtual focus.

Moreover, in the case the antenna is used on board a satellite, the structure must fulfil severe requirements of mechanical stiffness, thermal deformation and weight.

Its weight must be as light as possible and its stiffness must ensure mechanical resonance frequencies higher than a minimum value, depending on the nature of the vector and on the type of support used. That is to avoid vibrations detrimental to the antenna when placing the satellite in orbit. Finally, thermal distortions, depending on sun irradiation in the orbit, have to be kept within predetermined levels in order to ensure good electrical antenna performances in the whole range of thermal variations.

More particularly, in case of frequency selective subreflectors, in addition to normal electrical specifications of on-board antennas, a ratio between reflection and transmission frequency as low as possible is required.

That is due to the fact that the main reflector is optimized at a well-determined frequency, hence, the closer the operation frequencies to the optimal frequency, the better the electrical performances in the two bands used. Now, practical considerations, depending on the bandwidth of the transmitted signals, seem to indicate in 1.5 the lower limit obtainable for the ratio above.

So far, antenna systems have already been launched with frequency or polarization selective subreflectors such as those installed on board the Voyager spacecraft.

In this case, frequency selectivity has been obtained with a surface consisting of a plurality of dielectric layers on one of which a plane distribution of cross-like metallic elements with bidimensional periodicity has been fabricated.

Such elements are usually referred to as "crossed dipoles." Their dimensioning depends on the reflection frequency only. The properties of transparence are, on the contrary, due to the fact that, at the transmission frequency considered, the dielectric structure is practically transparent and the grid of metallic elements is inactive.

All the antennas of this kind, already placed in orbit, exhibit a ratio between relection and transmission frequency higher than 2. It is known in the literature (see e.g. "Multilayer frequency sensitive surface" L. W. Henderson et al, International Symposium on antennas and propagation—1982 Albuquerque (USA), pages 459–62) that lower ratios require the use of two grids of electromagnetically coupled conducting elements.

In such a way, by exploiting the interference effects between the two grids, it is possible to obtain an effect of total transmission at a frequency even considerably near the reflection one. The reflection frequency remains anyway dependent on the size of the conducting elements, which may have different shapes: crossed dipoles, rings, etc. The transmission frequency depends on the contrary on the distance between the two grids, which is proportional to the ratio between reflection and transmission frequencies.

Polarization selectivity of the antennas now in orbit is obtained by the use of surfaces composed of a plurality of dielectric layers on one of which there is a plane periodic distribution of parallel metallic stripes. In this way the reflection of electrical fields polarized parallely to the stripes and the transmission of orthogonally-polarized ones are obtained.

In all these antennas the desired electromechanical properties of the subreflector have been obtained by the use of convenient multilayer structures of composite materials, shaped like a plate or honeycomb; they form a convenient mechanical support to the reflecting metallic grid.

An obvious soluton to the problem of making an antenna with a low value of the ratio between the reflection and transmission frequencies and convenient for use on board the satellites could consist in fabricating on a mechanical support, as described above, two dichroic grids separated by a convenient number of dielectric layers. However, in this way one of the grids is close to the mechanical support, whose layers made of composite materials have a rather high dielectric constant generally higher than 3. It is known that this closeness entails the lowering of the reflection frequency of the dichroic grid, which can be compensated for only by an initial grid dimensioning for higher frequencies. This requirement makes the grid embodiment more difficult when the reflection frequency exceeds about 15 GHz.

This problem could be solved by separating the mechanical support from the set of the two grids by a dielectric layer with low dielectric constant and convenient thickness. Moreover, the obtained structure presents a number of disadvantages:

too high ohmic losses in the transmission band and negligible in the reflection band; that is due to the fact that in the transmission band electromagnetic fields have to cross the whole structure and hence also the mechanical support, whose thickness is rather considerable, to meet thermomechanical requirements, while in the reflection band electromagnetic fields are nearly completely reflected from the most external grid, therefore they do not undergo significant attenuations;

the dielectric layer with a low dielectric constant actually decouples from a thermal standpoint the mechanical support of the set of the two grids, in this way a bad behaviour in presence of thermal variations is to be expected.

SUMMARY OF THE INVENTION

These disadvantages are overcome by the dichroic antenna structure provided by the present invention, which presents a symmetrical behavior both from an electrical and thermomechanical point of view: the structure in fact exhibits comparable ohmic losses in the two operative bands and has a symmetrical plurality of layers with respect to the median section. It also allows the use of less thick composite-material layers with consequent reduction in ohmic losses and weight.

The present invention provides a dichroic antenna structure, comprising at least a grid reflecting, the electromagnetic radiation at a first frequency or polarization and transparent at a second frequency or orthogonal polarization, characterized in that it consists of the following series of layers:

a first dielectric layer with high mechanical resistance;

a first dielectric layer with low dielectric constant;

said grid;

a dielectric layer supporting said grid;

a second dielectric layer with low dielectric constant;

a second dielectric layer with high mechanical resistance.

BRIEF DESCRIPTION OF THE DRAWINGS

These and other characteristics of the present invention will be made clearer by the following description of a preferred embodiment there of, given by way of example and not in a limiting sense, and by the annexed drawings in which.

SPECIFIC DESCRIPTION

Figure 1:
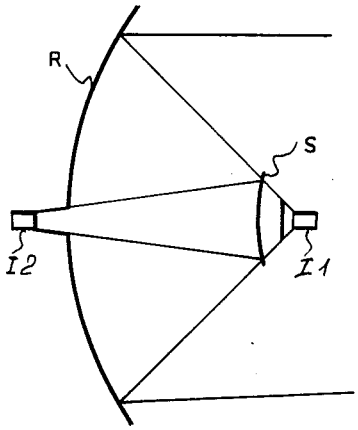
FIG. 1 shows a double-reflector antenna.

In FIG. 1, R denotes the main reflector and S the subreflector, I1 and I2 denote the two feeds placed at the primary and virtual foci of reflector R, respectively.

Signals reflected by R arrive at I1 after crossing S and at I2 after being reflected by S, which must therefore have a selective behavior, as previously mentioned.

Figure 2:
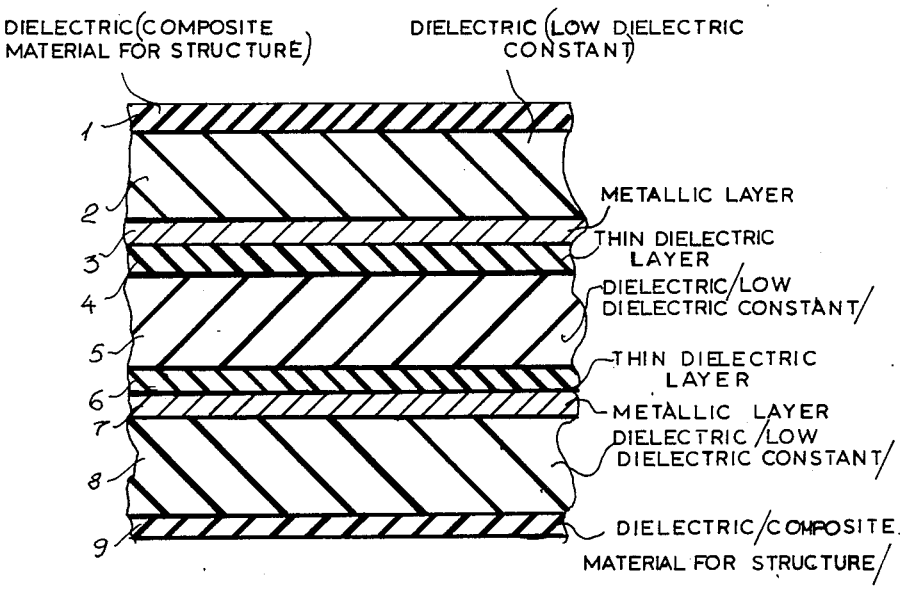
FIG. 2 shows a section of the subreflector structure provided by the invention.

Subreflector S is made with the structure provided by the invention, as depicted in FIG. 2.

FIG. 2 illustrates the structure of subreflector S. References 1 and 9 denote two dielectric layers of composite material, having the function of giving the whole structure the required mechanical stiffness and desired thermal properties to be used aboard satellites. The structure must fulfil severe requirements of mechanical stiffness, thermal deformation and weight. They directly depend on the distance between these layers and on their thickness.

References 2 and 8 denote two dielectric layers of material with low dielectric constant (about 1), having the following functions:

to determine the required distance between layers 1 and 9, after the distance between the dichroic grids has been fixed as donated by references 3 and 7;

to decouple electrically the two grids from layers 1 and 9, thus rendering their dimensioning independent both of the dielectric constant and of the thickness of the above-mentioned layers 1 and 9.

References 3 and 7 denote two layers such as two dichroic grids, whose elements are dimensioned so as to ensure a perfectly reflecting behavior in the required frequency band and transparent outside the band. The elements forming the grids can be fabricated with a photoetching process of metallic layers deposited on two thin dielectric layers, denoted by 4 and 6.

Finally, 5 denotes a dielectric layer with low dielectric constant, having the functon of keeping the two dichroic grids at a distance such as to ensure the effect of total transmission in the transmission band. This layer, as well as layers 2 and 8, can be fabricated with plastic foam or cellular dielectric material, e.g. honeycomb material.

From FIG. 2 one can understand that such a structure exhibits comparable ohmic losses in the two operative bands. Such losses are in fact basically due to crossings of layers 1 and 9, which, as mentioned, have a rather high dielectric constant and a certain thickness. In the transmission band the electromagnetic wave crossing the whole subreflector passes once through each of the two layers, in the reflection band the electromagnetic wave crosses twice the same layer, being completely reflected by the first grid it meets.

Overall attenuation effects are hence of the same order of magnitude. In addition, such attenuations can be kept below a certain predetermined value by suitably spacing layers 1 and 9 and consequently reducing their thickness. Such a structure can be protected by suitable varnishes without their chemical composition affecting the dimensioning of the dichroic grids.

The structure represented in FIG. 2 can be equally used when an only grid is sufficient, e.g. grid 7, by eliminating as a consequence layers 3, 4, 5.

The already-mentioned advantages in the thermomechanical behavior can be obtained. Of course dichroic grids can be replaced by parallel striped grids to obtain antennas sensitive to electric-field polarization.

The first results obtained in the preliminary dimensioning of a dichroic subreflector with a 1-m diameter show that the performances of this structure are much better than those obtainable according to the known art.

It is clear that what described has been given only by way of non limiting example. Variations and modifications are possible without going out of the scope of the present invention.

We claim:

1. A double reflecting antenna for use aboard satellites with a dichroic subreflector for a radiation, said radiation having first and second components, said first and said second components having at least one parameter selected from a group consisting of frequency and polarization said subreflector for reflecting said first of said components and transparent to said second of said components having a series of layers comprising:

a first dielectric layer with high mechanical resistance;

a second dielectric layer with low dielectric constant;

a first grid for reflecting said first of said components and transparent to said second of said components;

a third dielectric layer supporting said first grid;

a fourth dielectric layer with low dielectric constant;

a fifth dielectric layer with high mechanical resistance;

a second grid; and a sixth dielectric layer for supporting said second grid.

2. A double reflecting antenna for use aboard satellites with a dichroic subreflector for a radiation, said radiation having first and second components, said first and said second components having at least one parameter selected from a group consisting of frequency and polarization, said subreflector for reflecting said first of said components and transparent to said second of said components having a series of layers comprising:

a first dielectric layer with high mechanical resistance;

a second dielectric layer with low dielectric constant;

a first grid for reflecting said first of said components and transparent to said second of said components;

a third dielectric layer supporting said first grid;

a fourth dielectric layer with low dielectric constant;

a second grid;

a fifth dielectric layer for supporting said second grid;

a sixth dielectric layer with low dielectric constant; and a seventh dielectric layer with high mechanical resistance.

3. A structure as defined in claim 2 wherein said first, said fourth and said sixth dielectric layers are fabricated with plastic foam rubber.

4. A structure as defined in claim 2 wherein said first, said fourth and said sixth dielectric layers are fabricated with cellular structure material.

* * * * *